US008395062B2

(12) United States Patent
Suzuki

(10) Patent No.: US 8,395,062 B2
(45) Date of Patent: Mar. 12, 2013

(54) SWITCH AND DEVICE USING THE SWITCH

(75) Inventor: Katsuaki Suzuki, Ryugasaki (JP)

(73) Assignee: Tyco Electronics Raychem KK, Kawasaki (JP)

( * ) Notice: Subject to any disclaimer, the term of this patent is extended or adjusted under 35 U.S.C. 154(b) by 774 days.

(21) Appl. No.: 10/588,583

(22) PCT Filed: Feb. 2, 2005

(86) PCT No.: PCT/JP2005/001481

§ 371 (c)(1),
(2), (4) Date: Jun. 25, 2007

(87) PCT Pub. No.: WO2005/076301

PCT Pub. Date: Aug. 18, 2005

(65) Prior Publication Data

US 2007/0272525 A1 Nov. 29, 2007

(30) Foreign Application Priority Data

Feb. 6, 2004 (JP) ..... 2004-030418

(51) Int. Cl.
*H01H 15/02* (2006.01)

(52) U.S. Cl. ..... 200/16 R; 200/334

(58) Field of Classification Search ..... 200/16 R, 200/16 D, 16 C, 16 B, 333, 334, 302.1
See application file for complete search history.

(56) References Cited

U.S. PATENT DOCUMENTS 3,454,733 A 7/1969 Sanford et al.
4,833,280 A * 5/1989 Bingo et al. ..... 200/16 D
5,473,495 A 12/1995 Bauer
5,745,022 A 4/1998 Becher et al.
6,512,446 B2 * 1/2003 Wang et al. ..... 338/22 R

FOREIGN PATENT DOCUMENTS

EP 0363746 A1 4/1990

(Continued)

OTHER PUBLICATIONS

International Search Report for Internation Application No. PCT/JP2005/001481, mailed Apr. 12, 2005.

(Continued)

*Primary Examiner* — Amy Cohen Johnson
*Assistant Examiner* — Marina Fishman

(57) ABSTRACT

There is provided a novel switch having a function of overcurrent protection. In a switch comprising a conductive movable member (9) and at least two terminals (1, 2, 3) and being switchable by mechanically moving the movable member (9) between a state in which the movable member (9) contacts with the two terminals (1, 2) simultaneously and a state in which the movable member (9) is apart from either one (1) of the two terminals (1, 2), at least one (2) of the two terminals (1, 2) is separated into a conductive contact part (2*a*) for contacting with the movable member (9) and a conductive connect part (2*b*) for being electrically connected with an external element (not shown), and a PTC member (2*b*) is located between the contact part (2*a*) and the connect part (2*c*). The PTC member (2*b*) may be a PTC element having a PTC material layer and a pair of conductive material layers each located on opposed surfaces of the PTC material layer.

8 Claims, 3 Drawing Sheets

FOREIGN PATENT DOCUMENTS

| | | | |
|---|---|---|---|
| EP | 0756301 | A2 | 1/1997 |
| GB | 2341729 | A | 3/2000 |
| JP | 59-215617 | A | 12/1984 |
| JP | 3-121636 | A | 12/1991 |
| JP | 09-326225 | A | 12/1997 |
| JP | 10-188716 | | 7/1998 |
| JP | 11-329134 | A | 11/1999 |
| JP | 2003-297185 | A | 10/2003 |

OTHER PUBLICATIONS

Supplementary European Search Report for European Application No. 05709602.6, mailed May 23, 2007.

* cited by examiner (a)

(b)

(c)

(a)

(b)

(c)

SWITCH AND DEVICE USING THE SWITCH

TECHNICAL FIELD OF THE INVENTION

The present invention relates to a switch used for various electric and/or electronic devices and activated by a mechanical switching operation (hereinafter simply referred to as a "switch").

BACKGROUND OF THE INVENTION

In various electric/electronic devices, a switch activated by a mechanical switching operation is used to control, for example, switching of ON-OFF of a power supply and/or switching of electric circuits. It is known that such switch includes, for example, a slide switch, a toggle switch, a rotary switch, a push switch, a rocker switch (or a tumbler switch) and so on.

Conventionally, such switch is generally used in combination with a current fuse in order to improve safety of the electric/electronic device by protecting a load of the electric circuit from overcurrent (hereinafter such switch without a function of protection is referred to as the conventional general switch). For example, in an electric circuit of electric toys, home electric appliances or the like, the current fuse is used while being inserted between the switch and the load in series.

In recent years, a Positive Temperature Coefficient (PTC) element is used as an overcurrent protection element in place of the current fuse, and a switch using a PTC element is proposed (see, for example, Japanese Patent Publication No. JP-A-1998-188716. In this type of switch, the PTC element is located within an operating part so that the PTC element is serially connected with the load. More specifically, as to a rotary switch, the PTC element is incorporated in the operating part by embedding a PTC material (PTC resin) in the operating part rotatable in a certain plane and forming a polar plate on an exposed surface of the PTC material (see FIG. 3 in Patent Literature 1). According to this switch construction, there is provided the switch having a function of overcurrent protection, which is not necessarily used in combination with a current fuse.

The term "PTC material" in the present description means a material having a Positive Temperature Coefficient as is known in the field of the electric/electronic circuit technology. The PTC material has its electric resistance (or an impedance) at a relatively low level under a relatively low temperature condition (e.g. an ordinary or room temperature), but shows shew a steep increase in the electric resistance on exceeding a certain temperature (hereinafter referred to as a trip temperature). Throughout the present description, the former state of the PTC material is called "Low state," and the latter state thereof, "High state." Then, the "PTC element" means an element constructed by forming conductive members on a surface of the PTC material at a distance from each other. The conductive members function as electrodes, and are also simply referred to as electrodes or polar plates.

BRIEF SUMMARY DISCLOSURE OF THE INVENTION

In a case of the conventional general switch, since it is used in combination with a current fuse, a design of an electric/electronic device is limited by requiring a space for locating the current fuse in its housing. In addition to the necessity of the current fuse and its accessories (such as a cable), there is an additional disadvantage of requiring a step of soldering for electrically connecting the current fuse. Further, it is necessary to fix the current fuse to the housing so as to avoid short circuit due to detachment of the current fuse from the soldering portion. Furthermore, since the current fuse generally exposes a lead portion thereof, a risk of short circuit caused by any trouble would be expected. Further, there is also a disadvantage that it is hard to immediately detect a temperature anomaly when it occurs in the switch.

On the contrary, in a case of the above-described switch having a function of overcurrent protection, more specifically the rotary switch, the problems as above can be avoided. However, this type of switch incorporates the PTC element in its operating part, and the operating part may have a complicated structure in of the switch, and the size of the operating part is limited to some extent. Therefore, it is difficult to incorporate the PTC element in the operating part for various kinds of switches, e.g. a slide switch, a toggle switch and so on. In addition, in the above-described specific construction of the switch having a function of overcurrent protection, the PTC material is embedded in the operating part, and polar plates are formed on the same plane of the PTC material. Therefore, a current flows only in a relatively small volume portion of the PTC material, and the resistance of the PTC member in a Low state is very high. As a result, there arises another problem of very small current flowing through the electric circuit at a power ON state. Further, such polar plates are generally attached to the PTC material by thermal compression. When the switching operation which rotates the polar plates while contacting them with the underlying substrate is conducted repeatedly, the polar plate may be detached from the PTC material by friction between the polar plate and the substrate.

The present invention is made to solve the above problems, and the present invention aims to provide a novel switch having a function of overcurrent protection.

According to one aspect of the present invention, there is provided a switch comprising an electrically conductive movable member and at least two terminals and being switchable by mechanically moving the movable member between a state in which the movable member contacts with the two terminals simultaneously and a state in which the movable member is apart from either one of the two terminals, characterized in that at least one of the two terminals comprises (1) an electrically conductive contact part for contacting with the movable member, (2) an electrically conductive connect part for being electrically connected with an external element (e.g. a load or a power supply), and (3) a PTC member sandwiched between the contact part and the connect part.

The "PTC member" in the present invention means a member using a PTC material in general, unless otherwise specified. Such PTC member may be a PTC element having a PTC material layer (e.g. a sheet of a PTC material) and a pair of conductive material layers (e.g. metal foils) each located on opposed surfaces of the PTC material layer. In this case, the pair of conductive material layers functions as electrodes, and these conductive material layers are electrically connected with the contact part and the connect part, respectively. However, the present invention is not necessarily limited to this, the PTC member may be made of, for example, a PTC material layer alone. In such case, the contact part and the connect part which are electrically conductive function as electrodes, and the terminal having the PTC member as a whole has an equivalent function to the PTC element.

When such switch of the present invention is applied to an electric/electronic device, the PTC member (in particular, the PTC element) is inserted into an electric circuit in series, and thus there is provided the switch having a function of overcurrent protection. More specifically, the PTC member under the ordinary power ON state is at a Low state to allow a large current passing through a load, but once overcurrent occurs, the PTC member trips to a High state to effectively reduce and preferably substantially cut off the current flowing through the electric circuit. Thus, when the switch of the present invention is applied to an electric/electronic device, a current fuse (and its accessories) is omitted unlike in the case of the conventional general switch, so that there can be obtained advantages of a smaller space, simplification of producing steps of the electric/electronic device due to a fewer number of components and steps, and avoidance of risk of short circuit attributable to the soldering portion of the current fuse and the exposed portion of the lead. In addition, the PTC member also trips by overheating. In the event a temperature anomaly arises by fusion of the contact by arc generating on switching, heat generation at the contact associated with increase in a contact resistance, since the switch is provided with the PTC member, its function of overheat protection can effectively prevent the damage from spreading.

Since the switch of the present invention incorporates the PTC member in the terminal, the flexibility of its design is greater than a case in which the PTC member is incorporated in the operating part which has many limitations in structure and size. That is because the contact part and the connect part of the terminal can be readily changed in form with various metal processing techniques such as metal plate punching processing, plating, sputtering and so on and also can be used like a lead line, so that the PTC member is incorporated in any available space in the switch. Thus, the present invention can be widely applied to various kinds of switches such as a slide switch, a toggle switch, a rotary switch, a push switch, a rocker switch (or a tumbler switch) and so on. Fundamental structures of these switches excepting the characteristic portion of the present invention are omitted in this description since they are known in the art. However, the characteristics of the present invention will be applicable to various kinds of switches by those skilled in the art based on the present description.

Furthermore, according to the present invention the PTC member is sandwiched between the conductive contact part and the conductive connect part of the terminal, so that there is no risk of detachment of an electrode for the PTC member. In an example using the PTC member in which a pair of conductive material layers are each located on opposed surfaces of a PTC material layer, the conductive material layers functioning as the electrodes are sandwiched between the PTC material layer and the contact part or the connect part to be free from friction, so that there is no risk of detachment of the electrodes. In another example in which the PTC member consists of the PTC material layer, since the contact part and the connect part are conductive and function as electrodes themselves, there is no need to additionally provide an electrode(s) and also no risk of detachment of such electrode.

In addition, according to the present invention, since the PTC member is sandwiched between the contact part and the connect part of the terminal, it is possible to effectively use an area of the PTC member (a so-called chip area, more concretely an area of the opposed surfaces of the PTC material layer). That is, since a pair of the electrodes (more specifically conductive members being able to function as the electrodes) is each located on the opposed surfaces of the PTC material layer, the area of the electrodes can be made larger than those in a case in which the electrodes are located on the same surface. Therefore, the larger volume portion of the PTC material can flow a larger current therethrough, so that the resistance of the PTC material at a Low state can be lowered to improve the current efficiency at a power ON state. Thus, the present invention attains the higher current efficiency in comparison with the type of a switch having a function of protection where the PTC element is incorporated in its operating part (see Japanese Patent Publication No. JP-A-1998-188716 1). A ratio of areas of the conductive material layer to the PTC material layer in a contact plane of the PTC material layer with the conductive material layer (or a coverage ratio) is not less than 50%: the larger it becomes, the more preferable: and most preferably it is almost 100%.

The PTC material usable for the PTC member in the present invention comprises a polymer PTC material, a ceramic PTC material and so on. The polymer PTC material is made of a polymer material such as polyethylene and conductive particles such as carbon black and/or metal powder dispersed therein, and has a larger gap between the resistances at a Low state and a High state and a steeper rise in the resistance to a change in the temperature in comparison with the ceramic PTC material. Although the ceramic PTC material turns to increase in its resistance at an excessively low temperature (i.e. the temperature coefficient is converted from positive to negative), the polymer PTC material do not shows such phenomenon. Thus, the polymer PTC material is preferably used, but not limiting the present invention.

When the PTC material layer is used for the PTC member, the PTC material layer can be located in any appropriate arrangement as long as the PTC member is sandwiched between the contact part and the connect part of the terminal. Although all of the terminals are generally fixed to the same substrate, a primary plane (or a layer surface) of the PTC material layer may be positioned, for example, either generally perpendicular or generally parallel to a primary plane of the substrate.

When the PTC material layer is used for the PTC member, the PTC material layer may be retained between the contact part and the connect part with the use of a spacer in some cases. If an external force is applied on the PTC material, it causes a bad influence on the PTC characteristics (such as a resistance-temperature characteristic), and the aimed function of overcurrent protection may be fulfilled insufficiently. Especially when a pressing force is applied as the external force, the thickness of the PTC material becomes smaller to make the resistance at a Low state smaller, and cubical expansion by the temperature rise is inhibited by the pressing force, so that the function of overcurrent protection does not work until the temperature reaches a higher value. Thus, in the case using the PTC material layer for the PTC element, it is especially undesirable that the movable member or other members (such as a spring) apply the pressing force to the layer in its thickness direction. However, by using the spacer as described above, the spacer can supports the pressing force applied to the PTC material layer in its thickness direction, so that the influences on the PTC characteristics are alleviated. For this purpose, the spacer is preferably made of a material harder than the PTC material, such as a metal, a solid resin material or the like. The spacer may have any shape such as a plate, a column, or a sphere. Further, the spacer may be integrally formed with either the conductive contact part or the conductive connect part as long as these parts do not electrically contact with each other.

As long as the switch of the present invention has at least two terminals, the number of terminals and their arrangement are not specifically limited. The material, figure and structure of the terminal may be any appropriate one, as long as at least one of the two terminals which are electrically connectable to each other via the conductive movable member has the PTC member between the conductive contact part and the conductive connect part. The material, figure and movement of the movable member are not specifically limited as long as the mechanically and electrically contacting state between the movable member and the terminal is switched by mechanically moving the conductive movable member. In the context of the present descriptions, the phrase "mechanically moving the movable member" means that the movable member is moved by, for example, operating the operating part by hand to mechanically affect the movable member.

In an example, the switch of the present invention may comprise a first, a second, and a third terminal, and be switchable by mechanically moving the movable member between a state in which the movable member contacts with the first and the second terminals simultaneously and is apart from the third terminal and a state in which the movable member is apart from the first terminal and contacts with the second and the third terminals simultaneously, wherein the second terminal comprises an electrically conductive contact part for contacting with the movable member, an electrically conductive connect part for being electrically connected with an external element, and a PTC member sandwiched between the contact part and the connect part. Such switch is preferably used for switching of electric circuits.

However, the switch of the present invention is not limited to this, and can be widely used in various electric/electronic devices to control, for example, switching of ON-OFF of a power supply and/or switching of electric circuits.

Thus, according to other aspect of the present invention, there is provided a device provided with an electric circuit using the switch as described above. Such device may be various electric/electronic devices, such as electric toys, home electric appliances and others.

According to the present invention, there is provided a novel switch having a function of overcurrent protection. When the switch of the present invention is applied to an electric/electronic device, advantages of a smaller space, a fewer number of components, simplification of producing steps, improved safety and so on are attained in comparison with a case of using the conventional general switch in combination with a current fuse. Further, the switch of the present invention has advantages of higher degree of design flexibility (or higher possibility for application to various kinds of switch structures), improved safety, improved current efficiency and so on in comparison with the switch with a function of overcurrent protection having a PTC element in its operating part.

DESCRIPTION OF NUMERALS

Figure 1:
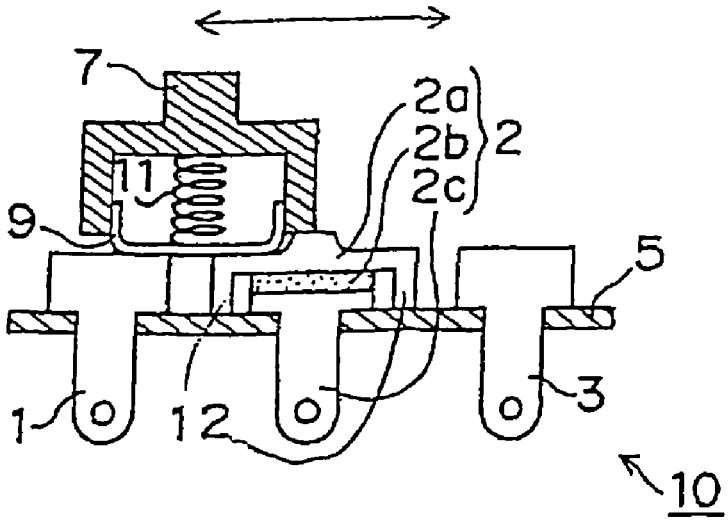
FIG. 1 shows a schematic view of a slide switch in one embodiment of the present invention, FIG. 1 (*a*) shows its schematic cross-sectional view, FIG. 1 (*b*) shows its schematic top plan view while omitting a movable member, and FIG. 1 (*c*) shows its schematic cross-sectional view taking along the X-X line in FIG. 1 (*b*).
Figure 1:
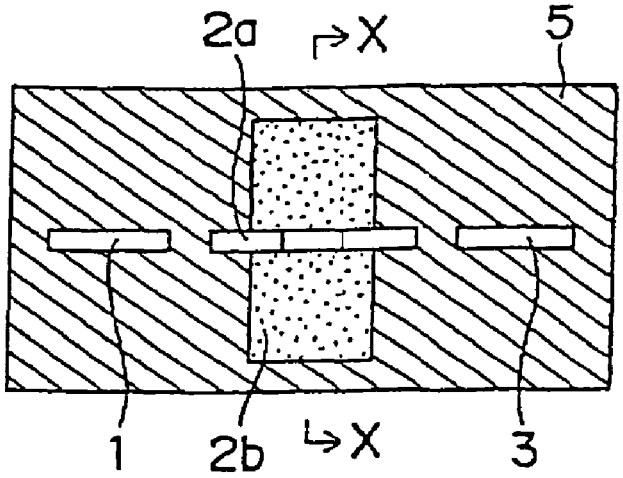
Figure 1:
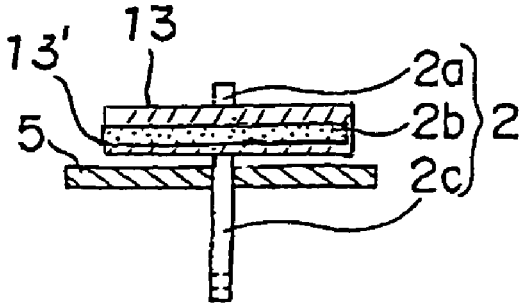

1, 2, 2', 3, 21, 22, 23: terminal
2*a*, 2*a'*, 22*a*: conductive contact part
2*b*, 2*b'*, 22*b*: PTC member
2*c*, 2*c'*, 22*c*: conductive connect part
5, 25: substrate
7, 27: operating part
9, 29: conductive movable member
11, 31: spring
12: spacer
13, 13': conductive material layers
33: post
35: converting element
10, 10', 20: switch

DETAILED DESCRIPTION OF THE INVENTION

Embodiment 1

An exemplary slide switch to which the present invention applied is described with reference to FIGS. 1(*a*) to (*c*). In general, a slide switch means a switch for opening and closing a path between contacts by sliding operation of an operating part. In this embodiment, an example of a single pole double throw-type slide switch which is utilizable for switching electric circuits is described.

As shown in FIGS. 1 (*a*) to (*c*), the slide switch 10 of this embodiment has a conductive movable member 9 and three terminals 1, 2 and 3. The terminals 1, 2 and 3 have a fixed contact and respectively fixed to a substrate 5. On the other hand, the movable member 9 has a movable contact, and the movable member 9, an operating part 7 and a spring 11 consist a movable component. As shown in FIG. 1 (*a*), the movable member 9 fits with a recess of the operating part 7 while being able to move up and down, and is pressed by an elastic force of the spring 11 in the recess against the terminals 1, 2 and 3. This slide switch 10 may be contained in a housing (not shown) having the substrate 5 as its bottom part while the upper end of the operating part 7 (hereinafter also referred to as a knob) is exposed from the housing and slidable in a direction of a left-right arrow.

In the slide switch 10 of this embodiment, the terminal 2 is composed of a contact part 2*a*, a connect part 2*c*, and a PTC member 2*b* sandwiched therebetween. More specifically, in the slide switch 10 of this embodiment, the PTC member 2*b* is inserted between the contact part 2*a* and the connect part 2*c* above the substrate 5 so that the opposed surfaces of the PTC member 2*b* are substantially parallel to the surface of the substrate 5 (see FIGS. 1 (*a*) and (*b*)).

The contact part 2*a* of the terminal 2 is a part for mechanically and electrically contacting with the movable member 9. While not limiting the present invention, the contact part 2*a* is provided with a projection on its top. The contact part 2*a* also has right and left edges which downwardly elongate to the surface of the substrate 5 at a distance from the PTC member 2*b* and the connect part 2*c*. These right and left edges of the contact part 2*a* have a sufficient hardness and function as a spacer 12 in the form of a plate. On the other hand, the connect part 2*c* is a part for being electrically connected with an external element (not shown, e.g. a load or a power supply) by, for example, soldering. As shown in the drawings, the connect part 2*c* may be in a shape similar to contact parts of the terminals 1 and 3. The contact part 2*a* and the connect part 2*c* are both made of a conductive material which is generally a metal material. The contact part 2*a* and the connect part 2*c* can be formed appropriately with a general metal processing technique such as metal punching.

The PTC member 2*b* of the terminal 2 is a PTC element having a PTC material layer and a pair of conductive material layers 13,13' each located on the opposed surfaces of the PTC material layer, and these conductive material layers in turn constitute the opposed surfaces of the PTC member 2*b* and contact with the contact part 2*a* and the connect part 2*c* to be electrically connected thereto. It is preferable to use a polymer PTC material as the PTC material. The layer of the polymer PTC material can be prepared by dispersing conductive particles such as carbon black and/or metal powder into a polymer material such as a polyethylene and shaping it in the form of a layer or sheet. The conductive material layers may be, for example, any metal foils, and the metal foils can be bonded to both surfaces of the PTC material layer by thermal compression or so. In this embodiment, the conductive material layers cover the whole of the opposed surfaces of the PTC material layer (the coverage ratio 100%).

The construction of the slide switch 10 in this embodiment may be similar to a conventional general slide switch excepting the terminal 2 described above (the conventional general slide switch has a terminal similar to the terminals 1 and 3 as a central terminal corresponding to the terminal 2). More specifically, the conductive movable member 9 can be a general metal contact. The operating part 7 and the substrate 5 can be a member made of an insulating material such as a resin material. The spring 11 can be a general helical spring or the like. The terminals 1 and 3 can be general metal terminals. The terminals 1 and 3 in the embodiment shown in the drawings are, but not limited to, terminals for soldering. These members can be prepared as corresponding members of the conventional slide switch.

Such slide switch 10 can be readily assembled by those skilled in the art after the members are respectively prepared as described above.

Then, the movement of the slide switch 10 is described. FIG. 1 (*a*) shows the state A in which the movable member 9 contacts with the terminals 1 and 2 simultaneously and is apart from the terminal 3 (the state in which a path between the fixed contacts of the terminals 1 and 2 is "closed" by the movable contact of the movable member 9 while a path between the fixed contacts of the terminals 2 and 3 is "opened"). When the operating part 7 slides in a direction to the right hand of the drawings, for example, by the knob held with a hand, the state A is switched into the state B in which the movable member 9 is apart from the terminal 1 and contacts with the terminals 2 and 3 simultaneously (the state in which the path between the fixed contacts of the terminals 2 and 3 are "closed" by the movable contact of the movable member 9 while the path the fixed contacts of the terminals 1 and 2 are "opened"). Then, when the operating part 7 slides reversely to the left hand of the drawings, the state B is switched into the sate A. That is, the switch 10 is switchable between the sates A and B by sliding the operating part 7 to mechanically move the movable member 9.

On switching, the movable member 9 moves up and down along an inner wall of the recess of the operating part 7 by resilience of the spring 11 to get across the projection of the contact part 2*a*. Thus, it assures the switching between the states A and B and provides a sense of switching.

Also by the resilience of the spring 11, a pressing force is applied to the contact part 2*a* in the thickness direction of the PTC member 2*b* via the movable member 9. However, according to this embodiment, the pressing force is supported by the right and left edges of the contact part 2*a* which function as a spacer 12 to decrease a force applied to the PTC member 2*b*. As a result, it becomes possible to reduce the influence of the pressing force on the PTC characteristics of the PTC member 2*b* and sufficiently fulfill the function of overcurrent protection.

According to the slide switch 10 of this embodiment, the terminal 2 is provided with the PTC member 2*b*, and the PTC member 2*b* is inserted into an electric circuit in series either at the state A or B. Thus, if an overcurrent flows the electric circuit, the PTC member 2*b* trips to its High state to reduce the current by fulfilling the function of overcurrent protection.

Since application of such slide switch 10 having the function of overcurrent protection to an electric/electronic device makes a current fuse unnecessary, a smaller space, a fewer number of components, and simplification of producing steps, and higher safety can be attained in comparison with a case using the conventional general slide switch. Further, the slide switch having the function of overcurrent protection can be realized according to this embodiment, whereas the construction of the switch having the function of overcurrent protection incorporating the PTC element in its operating part (see Patent Literature 1) is difficult to be utilized in a slide switch or a toggle switch, in which a conductive movable member moves together with an operating part. Furthermore, according to this embodiment, since the PTC member is sandwiched between the contact part and the connect part of the terminal, there is no risk of detachment of an electrodes (the conductive material layers of the PTC member in this embodiment) to offer higher safety. In addition, according to this embodiment, since the whole of the opposed surfaces of the PTC material layer is covered with the conductive material layers, an area of the PTC member (a so-called chip area) can be utilized to the maximum extent to allow a very large current flowing at an ordinary power ON state, so that the obtained current efficiency is very high.

In this embodiment, the described switch is the single pole double throw-type slide switch which is switchable between the sates A and B and utilizable for switching electric circuits, but it will be understood by those skilled in the art that the slide switch 10 in this embodiment may be modified in various ways.

For example, the contact part 2*a* may have a flat top to provide an option of the neutral state N in which the movable member 9 contacts with the terminal 2 only and is apart from both of the terminals 1 and 3. At this neutral state N, a path between any two of the fixed contacts is "opened" resulting in current OFF. The switch can also be modified by eliminating the terminal 3 into a single pole single throw-type switch which is utilizable for switching of ON-OFF of a power supply.

In place of the right and left edges of the terminal 2*a* which function as a spacer 12, a spacer being in other form and made of any appropriate material can be used. In other embodiment, the spacer can be omitted if the influence of the external force on the characteristics of the PTC material does not cause a problem.

The contact part 2*a* and the connect part 2*c* in this embodiment are in the form of a plate (see FIG. 1 (*c*)), but not limited to such form and may be in any form. For example, the connect part 2*c* may be formed to fill a space between the substrate 5 and the PTC member 2*b*.

Further, the PTC member 2*b* used in this embodiment is the PTC element provided with the conductive material layers (electrodes) to cover the whole of the opposed surfaces of the PTC material layer (the coverage ratio 100%), but the whole of the opposed surfaces is not necessarily covered. The coverage ratio may be at least 50%. The higher the coverage ratio becomes, the more preferable. In other embodiment, the conductive material layers may be omitted, and only the PTC material layer can be used as the PTC member 2*b*. In such embodiment, the contact part 2*a* and the connect part 2*c* function as the electrodes, and the terminal 2 as a whole has an equivalent function to the PTC element.

The PTC material layer used in this embodiment is the polymer PTC material, but the present invention is not limited to this, and a ceramic PTC material may be used in place of the polymer PTC material.

Embodiment 2

Figure 2:
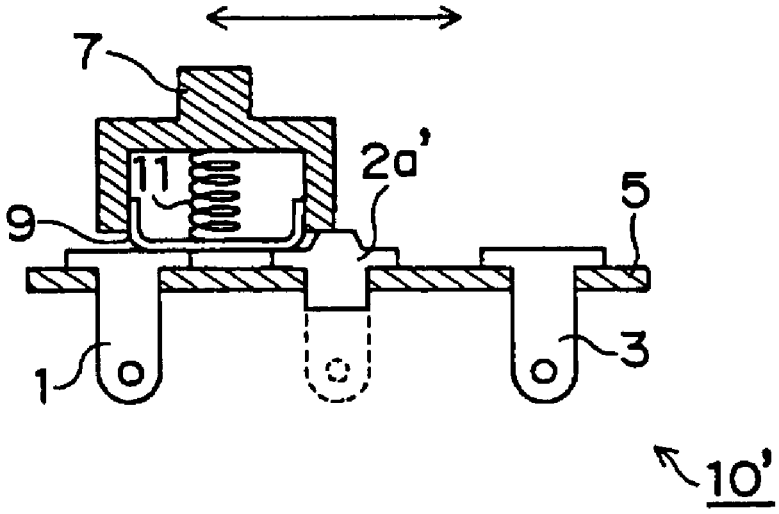
FIG. 2 shows a schematic view of a slide switch in another embodiment of the present invention, FIG. 2 (*a*) shows its schematic cross-sectional view, FIG. 2 (*b*) shows its schematic top plan view while omitting a movable member, and FIG. 2 (*c*) shows its schematic cross-sectional view taking along the Y-Y line in FIG. 2 (*b*).
Figure 2:
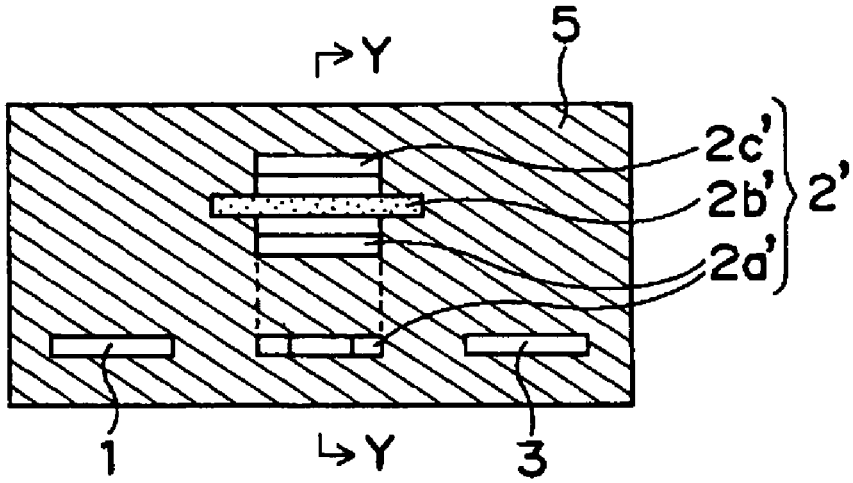
Figure 2:
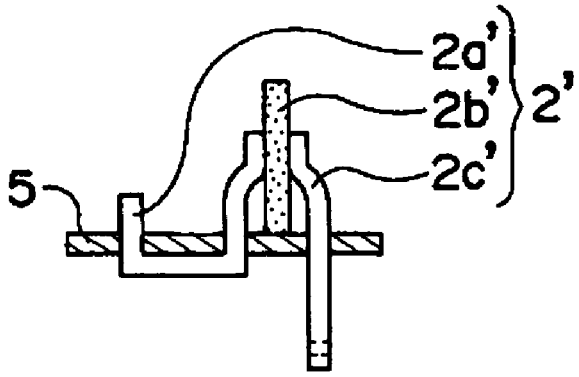

Another exemplary slide switch to which the present invention applied is described with reference to FIGS. 2 (*a*) to (*c*). This embodiment is modified one of the slide switch of the above Embodiment 1.

The slide switch 10' of this embodiment has a construction similar to the slide switch 10 of the above Embodiment 1, excepting the structure of a terminal 2'. In FIGS. 2 (*a*) to (*c*), members or elements corresponding to those shown in FIGS. 1 (*a*) to (*c*) are shown with similar numerals. The slide switch 10' of this embodiment is similar to the slide switch 10 of the Embodiment 1, unless otherwise specified hereinafter.

The terminal 2' is composed of a contact part 2*a*', a connect part 2*c*', and a PTC member 2*b*' sandwiched therebetween. More specifically, the contact part 2*a*' runs along the substrate 5, and the PTC member 2*b*' stands on the substrate 5 between the contact part 2*a*' and the connect part 2*c*' so that the opposed surfaces of the PTC member 2*b*' are substantially vertical to the surface of the substrate 5 (see FIGS. 2 (*b*) and (*c*)). Portions of the contact part 2*a*' and the connect part 2*c*' for sandwiching the PTC member 2*b*' are opposed to each other at a distance corresponding to the thickness of the PTC member 2*b*', and may function as a plate spring for holding the PTC member 2*b*' therebetween.

The slide switch 10' of this embodiment has a function of overcurrent protection similarly to the slide switch 10 of the Embodiment 1. According to the slide switch 10' of this embodiment, since a pressing force applied to the contact part 2*a*' from the movable member 9 is not transmitted to the PTC member 2*b*', it is avoidable without a spacer that the external force badly influences the PTC characteristics of the PTC member 2*b*', In the case in which the contact part 2*a*' and the connect part 2*c*' function as a plate spring, the pressing force of these plate springs on the PTC member 2*b*' in its thickness direction can be at a degree sufficient to hold the PTC member 2*b*', thus can be decreased as small as a certain degree at which the pressing force does not cause the bad influence on the PTC characteristics.

Also according to such slide switch of this embodiment, the effects similarly to the slide switch of the Embodiment 1 can be obtained. The slide switch of this embodiment can also be modified as described in the Embodiment 1.

Embodiment 3

An exemplary toggle switch to which the present invention is applied is described with reference to FIGS. 3 (*a*) and (*b*). In general, a toggle switch means a switch for opening and closing a path between contacts by changing operation of an operating part between upright and tilted positions. In this embodiment, an example of a single pole double throw-type toggle switch which is utilizable for switching electric circuits and ON-OFF of a power supply is described.

Figure 3:
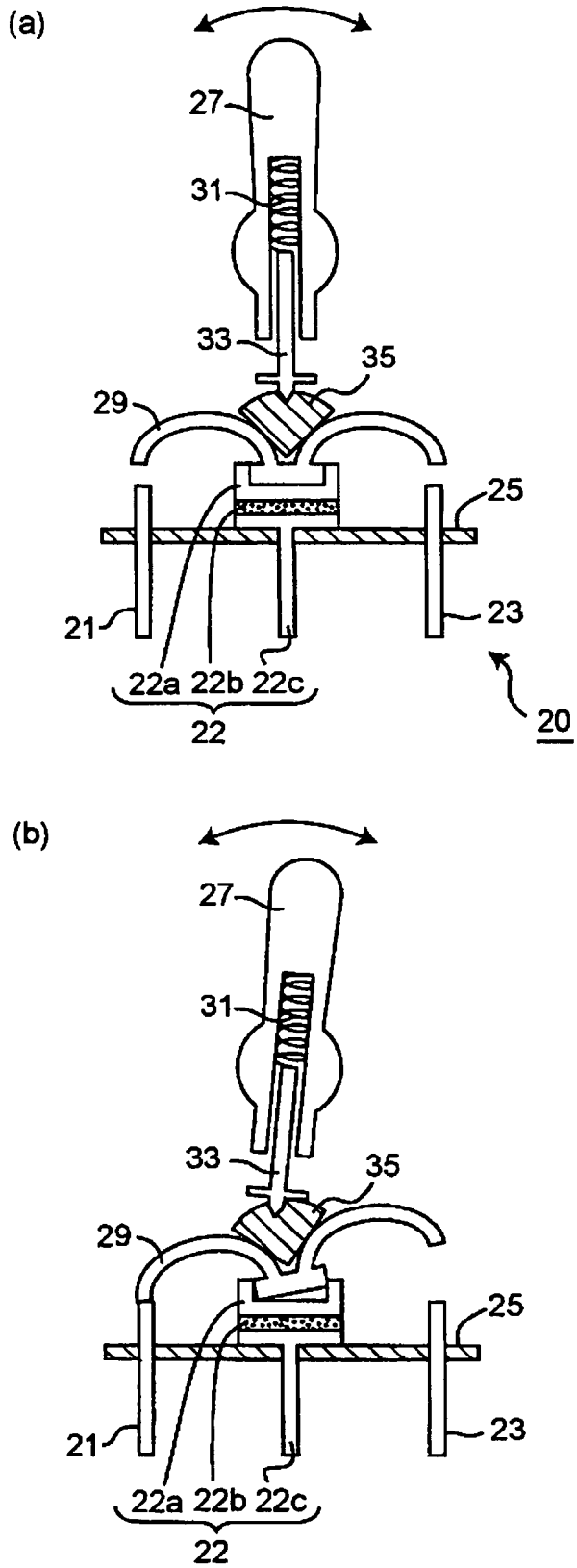
FIG. 3 shows a schematic view of a toggle switch in other embodiment of the present invention, FIG. 3 (*a*) shows its schematic cross-sectional view in a neutral state, and FIG. 3 (*b*) shows its schematic cross-sectional view in an unneutral state.

As shown in FIGS. 3 (*a*) and (*b*), the toggle switch 20 of this embodiment has a conductive movable member 29 and three terminals 21, 22 and 23. The terminals 21, 22 and 23 have a fixed contact and respectively fixed to a substrate 25. On the other hand, the movable member 29 has a movable contact, the movable member 29, an operating part 27, a spring 31, a post 33, and a converting element 35 consist a movable component. As shown in the drawings, the movable member 29 is in the form in which two curved parts are connected to each other via a central part, and the central part fits within the terminal 22 (more specifically, a contact 22*a* hereinafter described). The converting element 35 which is electrical insulating is located on the movable member 29 to contact with both of the curved parts of the movable member 29, and the tip of the converting element 35 is inserted into a recess between the curved parts. One end of the post 33 is implanted in the converting element 35 at its center top. In the vicinity of the one end of the post 33, protrusions extending in the right and left directions are formed at a distance from the converting element 35. The other end of the post 33 is positioned in a cavity of the operating part 27. The post 33 is pressed against the converting element 35 by an elastic force of the spring 31 positioned in the cavity of the operating part 27. This toggle switch 20 may be contained in a housing (not shown) having the substrate 25 as its bottom part while the upper end of the operating part 27 (hereinafter also referred to as a lever) is exposed from the housing and tiltable in a direction of a left-right arrow. The operating part 27 has a lower round portion which contacts with the inner wall of the housing (not shown), and this contact point may become a supporting point when the upper end of the operating part tilts.

In the toggle switch 20 of this embodiment, the terminal 22 is composed of a contact part 22*a*, a connect part 22*c*, and a PTC member 22*b* sandwiched therebetween. More specifically, in the toggle switch 20 of this embodiment, the PTC member 22*b* is inserted between the contact part 22*a* and the connect part 22*c* above the substrate 25 so that the opposed surfaces of the PTC member 22*b* are substantially parallel to the surface of the substrate 25. The PTC member 22, as in the Embodiment 1, is a PTC element having a PTC material layer and a pair of conductive material layers each located on the opposed surfaces of the PTC material layer.

The function, form, material and manufacturing method and so on of the contact part 22*a*, the PTC member 22*b*, and the connect part 22*c* of the terminal 22 will be understood by those skilled in the art by referring the Embodiment 1.

The construction of the toggle switch 20 in this embodiment may be similar to a conventional general toggle switch excepting the terminal 22 described above (the conventional general toggle switch has a terminal similar to the terminals 21 and 23 as a central terminal corresponding to the terminal 22). More specifically, the conductive movable member 29 can be a general metal contact. The converting element 35 and the substrate 25 can be a member made of an insulating material such as a resin material. The spring 31 can be a general helical spring or the like. The operating part 27 and the post 33 are not specifically limited, and can be made of any suitable material. The terminals 21 and 23 can be general metal terminals. The terminals 21 and 23 in the embodiment shown in the drawings are, but not limited to, PC terminals. These members can be prepared as corresponding members of the conventional toggle switch.

Such toggle switch 20 can be readily assembled by those skilled as in the case of the Embodiment 1.

Then, the movement of the toggle switch 20 is described. FIG. 3 (*a*) shows the neutral state N in which the operating part 27 stands upright and the movable member 29 contacts with the terminal 22 and is apart from the terminals 21 and 23. When the operating part 27 tilts in a direction to the right hand of the drawings, for example, by the lever held with a hand, the post 33 also tilts toward the right hand and presses the converting element 35 by the elastic force of the spring 31 to make it tilt toward the left hand. Thus, the movable member 29 falls toward the left hand under the pressing force from the operating part 27, so that the head of the left-hand curved part comes to contact with the top of the terminal 21. At this situation, the right-hand protrusion of the post 33 contacts with the converting element 35 to function as a limiter. Therefore, as shown in FIG. 3 (*b*), the above state N is switched into the state A in which the movable member 29 contacts with the terminals 21 and 22 simultaneously and is apart from the terminal 23 (the state in which a path between the fixed contacts of the terminals 21 and 22 are "closed" by the movable contact of the movable member 29 while a path between the fixed contacts of the terminals 22 and 23 are "opened"). Then, when the operating part 27 tilts reversely toward the left hand of the drawings, the movable member 29 falls toward the right hand by the reversed mechanism to that described above, so that the head of the right-hand curved part comes to contact with the top of the terminal 23. Therefore, the above state is switched into the state B in which the movable member 29 contacts with the terminals 22 and 23 simultaneously and is apart from the terminal 21 (the state in which the path between the fixed contacts of the terminals 22 and 23 are "closed" by the movable contact of the movable member 29 while the path between the fixed contacts of the terminals 21 and 22 are "opened"). That is, the switch 20 is switchable between the sates A, N and B by changing the operating part 27 between the upright and tilted positions to mechanically move the movable member 29.

According to the toggle switch 20 of this embodiment, the terminal 22 is provided with the PTC member 22*b*, and the PTC member 22*b* is inserted into an electric circuit in series either at the state A or B. Thus, if an overcurrent flows the electric circuit, the PTC member trips to its High state to reduce the current by fulfilling the function of overcurrent protection, and therefore the effects as in the case of the Embodiment 1 can be obtained.

In this embodiment, the described switch is the single pole double throw-type toggle switch is described which is switchable between the states A, N and B and utilizable for switching ON-OFF of a power supply and for switching electric circuits, but the toggle switch 20 in this embodiment may be modified in various ways.

Any spacer for maintaining the thickness of the PTC member is not used in this embodiment, but a component of the pressing force in the thickness direction of the PTC member 22*b*, which is generated by the tilt of the operating part 27 toward the right and left hands, is small enough not to badly influence the PTC characteristics, and does not substantially cause a problem.

However, if such pressing force is not negligible, the component of the pressing force can be reduced by adjusting the elasticity of the spring 31. For example, as to the shown embodiment, the pressing force against the PTC member can be reduced by decreasing the number of windings and/or decreasing the wire diameter of the helical spring 31. In other embodiment, a spacer may be used so that, for example, the contact part 22*a* is formed with having right and left edges functioning as a spacer similarly to the contact part 2*a* in the Embodiment 1.

Further, the PTC member used in this embodiment is the PTC element provided with the conductive material layers (electrodes) to cover the whole of the opposed surfaces of the PTC material layer, but it may be modified similarly to that described in the Embodiment 1.

Although three embodiments of the switch of the present invention have been described as above, the present invention is not limited to these, and it would be understood by those skilled in the art that they could be modified in various ways without departing the fundamental concept of the present invention. By arbitrarily selecting, for example, the type or kind of the switch, the number of the pole, the number of the throw and so on, the present invention can be applied to various switches.

The switch of the present invention can be used as a switch having a function of overcurrent protection for controlling, for example, switching of ON-OFF of a power supply and/or switching of electric circuits while it is incorporated in an electric circuit of various electric/electronic devices such as electric toys, home electric appliances and others.

The invention claimed is:

1. A switch comprising a conductive movable member and at least first and second terminals and being switchable by mechanically moving the movable member between a state in which the movable member contacts with the first and second terminals simultaneously and a state in which the movable member is apart from either one of the first and second terminals, wherein at least one of the first and second terminals comprises (i) a conductive contact part for contacting with the movable member, the conductive contact part being formed with edges functioning as a spacer;

(ii) a conductive connect part for being electrically connected with an external element; and (iii) a PTC member located between the contact part and the connect part, said PTC member comprising a PTC element having a PTC material layer and a pair of conductive material layers each located on opposed surfaces of the PTC material layer, the pair of conductive material layers comprising metal foils being electrically connected with the contact part and the connect part, respectively.

2. The switch according to claim 1, wherein the first and second terminals are fixed to a substrate, and the PTC material layer is positioned generally parallel to the substrate.

3. The switch according to claim 1, wherein the PTC material layer is retained between the conductive contact part and the conductive connect part by means of the with a spacer formed by the edges of the conductive contact part.

4. The switch according to claim 1, wherein the switch further comprises a third terminal, and is switchable by mechanically moving the movable member between a state in which the movable member contacts with the first and the second terminals simultaneously and is apart from the third terminal and a state in which the movable member is apart from the first terminal and contacts with the second and the third terminals simultaneously, and wherein the second terminal comprises a conductive contact part for contacting with the movable member, a conductive connect part for being electrically connected with an external element, and a PTC member located between the contact part and the connect part.

5. The switch according to claim 1, wherein the switch is selected from the group consisting of a slide switch, a toggle switch, a rotary switch, a push switch, and a rocker switch.

6. A device comprising an electric circuit using the switch according to claim 1.

7. The switch according to claim 4, wherein the switch is selected from the group consisting of a slide switch, a toggle switch, a rotary switch, a push switch, and a rocker switch.

8. A device comprising an electric circuit using the switch according to claim 4.

* * * * *